US011155425B2

(12) United States Patent
Fujikura et al.

(10) Patent No.: US 11,155,425 B2
(45) Date of Patent: Oct. 26, 2021

(54) SHEET FEED DEVICE

(71) Applicant: FUJIFILM Business Innovation Corp., Tokyo (JP)

(72) Inventors: Hiroaki Fujikura, Kanagawa (JP); Masashi Ikeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 17 days.

(21) Appl. No.: 16/866,529

(22) Filed: May 4, 2020

(65) Prior Publication Data

US 2021/0039898 A1 Feb. 11, 2021

(30) Foreign Application Priority Data

Aug. 6, 2019 (JP) ..... JP2019-144780

(51) Int. Cl.
*B65H 1/04* (2006.01)
*B65H 1/14* (2006.01)

(52) U.S. Cl.
CPC ..... *B65H 1/04* (2013.01); *B65H 1/14* (2013.01); *B65H 2403/51* (2013.01); *B65H 2403/72* (2013.01); *B65H 2405/115* (2013.01); *B65H 2511/11* (2013.01)

(58) Field of Classification Search
CPC ... B65H 1/04; B65H 1/14; B65H 1/26; B65H 1/266; B65H 2403/51; B65H 2403/511; B65H 2403/512; B65H 2403/72; B65H 2403/724; B65H 2405/115; B65H 2405/15; B65H 2405/11164; B65H 2405/353; B65H 2511/11
See application file for complete search history.

(56) References Cited

U.S. PATENT DOCUMENTS 6,246,466 B1 * 6/2001 Hirano ..... B41J 13/0081 271/145
6,862,426 B2 * 3/2005 Kitamura ..... G03B 27/00 271/145
9,359,157 B2 * 6/2016 Niikura ..... B65H 3/48
2012/0256367 A1 * 10/2012 Matsushima ..... B65H 1/14 271/147
2013/0069302 A1 * 3/2013 Naoi ..... B65H 1/14 271/126

FOREIGN PATENT DOCUMENTS

JP 2016000653 1/2016

* cited by examiner

*Primary Examiner* — Prasad V Gokhale
(74) *Attorney, Agent, or Firm* — JCIPRNET

(57) ABSTRACT

A sheet feed device includes: a tray provided in a device body in a manner capable of being pulled out and having a loading part that is moved up and down; an extension part attached to the device body to support a portion of a sheet to be fed through the tray; a lifting mechanism that has a lifting/lowering part for moving the loading part up and down and a driving part for lifting and holding the loading part via the lifting/lowering part; and a disconnecting part that disconnects the lifting/lowering part and the driving part when an uncoupling operation is accepted in a state in which the tray is accommodated in the device body.

13 Claims, 12 Drawing Sheets

10

SHEET FEED DEVICE

CROSS-REFERENCE TO RELATED APPLICATIONS

This application is based on and claims priority under 35 USC 119 from Japanese Patent Application No. 2019-144780 filed Aug. 6, 2019.

BACKGROUND

(i) Technical Field

The present disclosure relates to a sheet feed device.

(ii) Related Art

Japanese Unexamined Patent Application Publication No. 2016-000653 discloses a paper feed device.

This paper feed device has a removable long-paper optional part having an extension base plate, which extends a base plate of a paper feed tray to enable loading of long paper. A handle body is gripped and operated by a user when sliding the paper feed tray. A second lock structure moves, in association with the sliding operation of the handle body, from a second lock position, where the paper feed tray cannot be slid, to a second unlock position, where the paper feed tray can be slid. A first lock structure can be held at a first lock position, where the paper feed tray cannot be slid when the long-paper optional part is attached, thereby locking the second lock structure so as not to move from the second lock position to the second unlock position. The first lock structure can also be held at a first unlock position, where the paper feed tray can be slid when the long-paper optional part is removed.

SUMMARY

Aspects of non-limiting embodiments of the present disclosure relate to providing a sheet feed device in which a loading part can be lowered in response to pulling of a tray, without needing to reversely rotating a motor for lifting the loading part, compared with the configuration in which the loading part cannot be lowered while the tray is accommodated in a device body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet feed device including: a tray provided in a device body in a manner capable of being pulled out and having a loading part that is moved up and down; an extension part attached to the device body to support a portion of a sheet to be fed through the tray; a lifting mechanism that has a lifting/lowering part for moving the loading part up and down and a driving part for lifting and holding the loading part via the lifting/lowering part; and a disconnecting part that disconnects the lifting/lowering part and the driving part when an uncoupling operation is accepted in a state in which the tray is accommodated in the device body.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
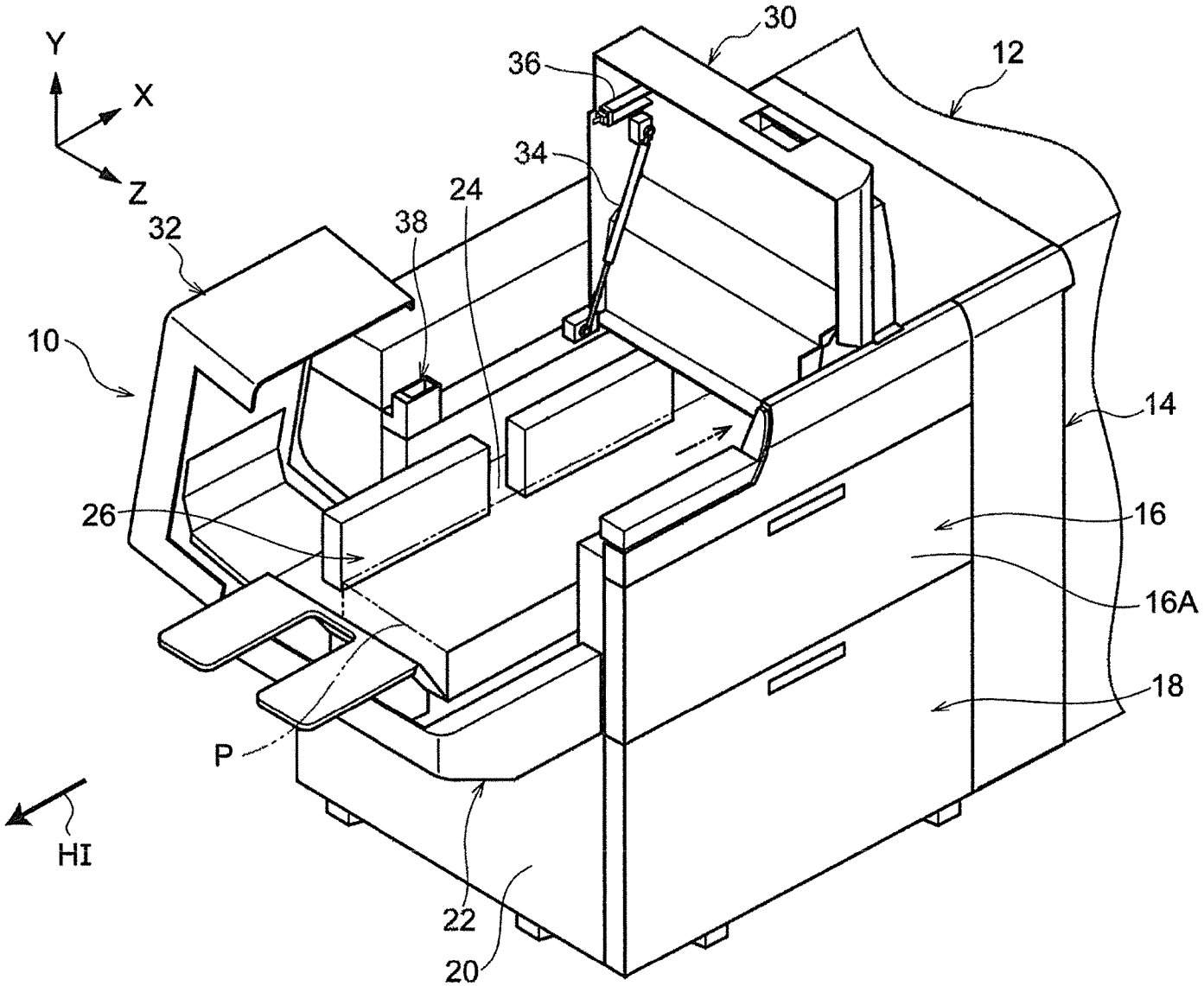
FIG. 1 is a perspective view of a sheet feed device according to a first exemplary embodiment.

A first exemplary embodiment will be described below with reference to the drawings. In the description below, the directions corresponding to the arrow X and the arrow Y in the drawings correspond to the width direction and the height direction of a sheet feed device, respectively. Furthermore, a direction (arrow Z direction) perpendicular to the width and height directions corresponds to the depth direction of the sheet feed device.

FIG. 1 is a perspective view of a sheet feed device 10 according to this exemplary embodiment. FIG. 1 shows a part of an image forming apparatus 12, to which the sheet feed device 10 transports a sheet P. The image forming apparatus 12 forms an image on the sheet P and includes an image forming unit (not shown) for forming an image on the sheet P and a transport unit (not shown) for transporting the sheet P to the image forming unit. The image forming apparatus 12 may use any of various image forming methods, such as an ink jet method, a xerography method, a relief printing method, a planography method, and an intaglio printing method.

An upper tray 16 and a lower tray 18 accommodating sheets P are provided in a device body 14 of the sheet feed device 10 in a manner capable of being pulled out of the device body 14. An optional extension part 22 can be attached to one side 20 on a first side HI in the width direction of the device body 14. FIG. 1 shows a state in which the extension part 22 is attached.

The sheet feed device 10 is formed by attaching the extension part 22 to the device body 14. The sheet feed device 10 enables feeding of a long sheet P and image forming on the long sheet P.

The sheet P is, in other words, a medium or a film on which an image is formed. Examples of the sheet P include a sheet of paper and an OHP sheet made of polyethylene terephthalate (PET) resin. Examples of the sheet on which an image is formed include a normal sheet fed from the trays 16 and 18 and a long sheet P fed by using the extension part 22.

Normal sheets are sheets that can be accommodated in the upper tray 16 without needing to attach the extension part 22 and have a length of, for example, 488 mm or less. Long sheets are sheets that require the extension part 22 and have a length of greater than 488 mm and less than or equal to 1500 mm.

The extension part 22, together with, for example, a height-increasing member 24 disposed on the upper tray 16, constitutes a sheet accommodating part 26 for accommodating long sheets P. The extension part 22 supports a portion of the sheet P to be supplied via the upper tray 16.

The sheet accommodating part 26 can be exposed and covered by a cover 30 supported by the device body 14 and an extension cover 32 supported by the extension part 22. A damper 34 extending from the device body 14 is connected to the cover 30 to assist the opening/closing operation.

An actuation bar 36 extends from the back surface of the cover 30, and the device body 14 has an insertion part 38 into which the actuation bar 36 is inserted. The insertion part 38 is provided with an open/close sensor (not shown) for detecting the open/close state of the cover 30. An example of the open/close sensor is a switch that is turned on when the actuation bar 36 is inserted into the insertion part 38.

Figure 3:
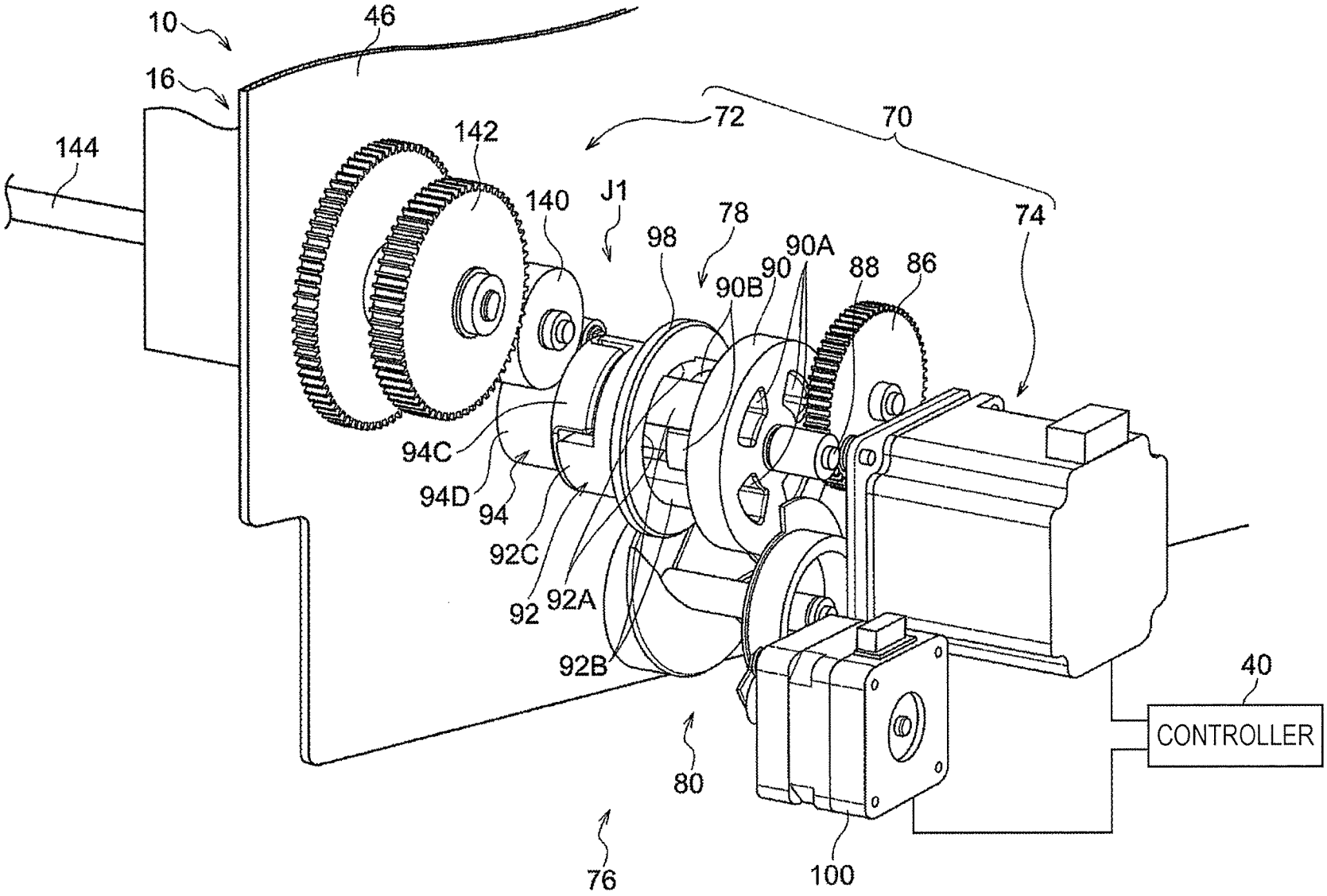
FIG. 3 is a view from arrow A in FIG. 2.

The open/close sensor detects a cover closed state, in which the actuation bar 36 is inserted into the insertion part 38, and a cover open state, in which the actuation bar 36 is removed from the insertion part 38, and transmits a signal to a controller 40 (see FIG. 3).

The controller 40 grasps whether the cover 30 is open or closed, based on the signal from the open/close sensor. When the cover 30 is opened, and consequently the cover open state is detected, the controller 40 recognizes that an uncoupling operation is accepted and disconnects a lifting/lowering part 72 and a driving part 74 (described below). If the driving part 74 is operating at this time, the driving part 74 is stopped.

The controller 40 may recognize that an uncoupling operation is accepted when the extension cover 32 is opened.

In this exemplary embodiment, although a case where the acceptance of the uncoupling operation is performed based on the opening operation of the cover 30 will be described as an example, the configuration is not limited thereto. For example, the acceptance of the uncoupling operation may be performed based on an uncoupling operation through an operation panel provided on the device body 14.

Figure 2:
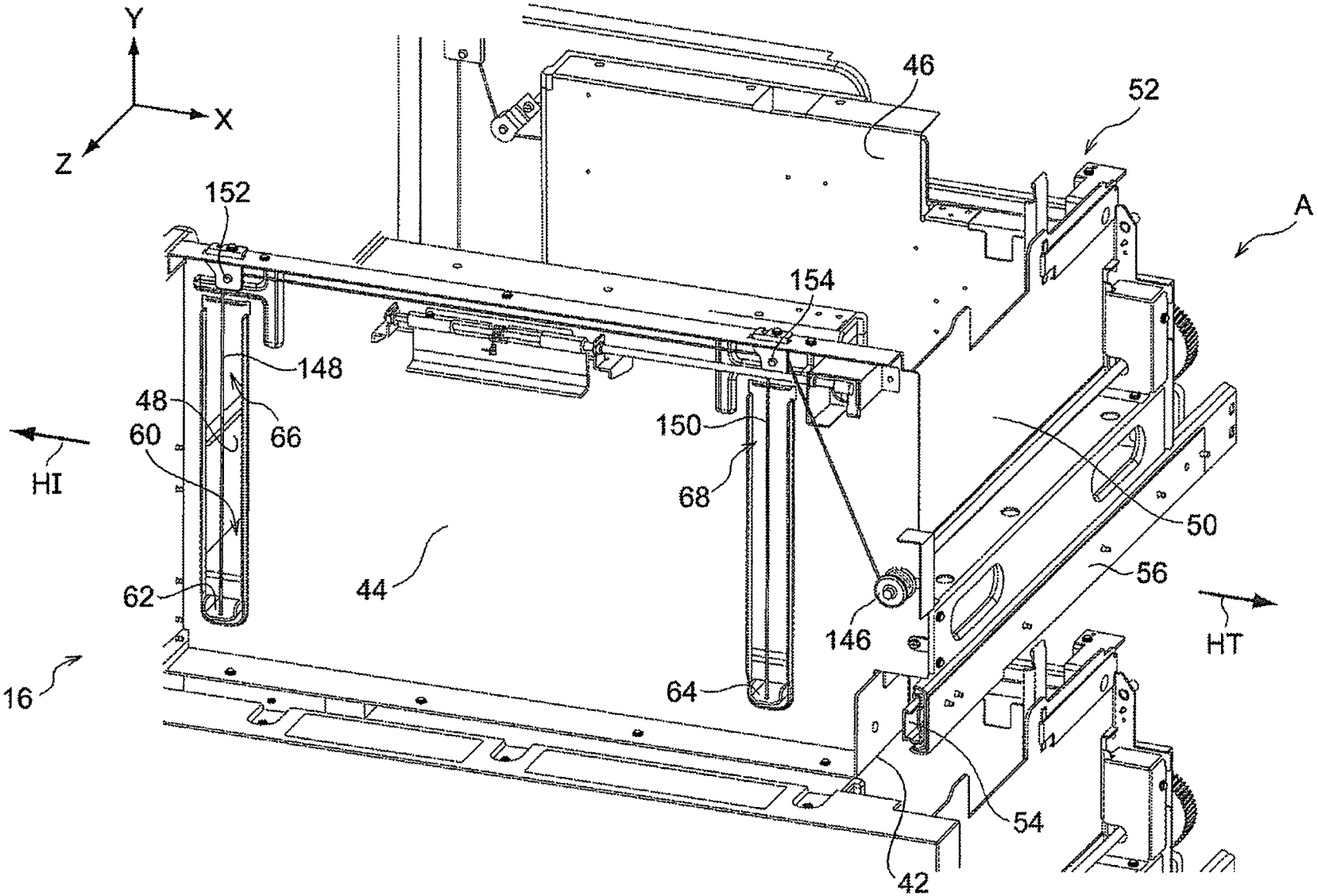
FIG. 2 is a perspective view showing the inside of an upper tray according to the first exemplary embodiment.

FIG. 2 shows the upper tray 16 without a covering part 16A for covering the front side of the upper tray 16. The upper tray 16 includes a base plate 42, a front plate 44 extending upward from the front side of the base plate 42 in the depth direction Z, and a rear plate 46 extending upward from the rear side of the base plate 42 in the depth direction Z. The upper tray 16 also includes a first side plate 48 extending upward from the first side HI in the width direction X of the base plate 42, and a second side plate 50 extending upward from a second side HT in the width direction X of the base plate 42. The heights of the first side plate 48 and the second side plate 50 are set to be lower than the heights of the front plate 44 and the rear plate 46, and a passing space 52 through which the sheet P to be fed passes is provided above the second side plate 50.

The first side plate 48 and the second side plate 50 are each provided with a supported rail 54 (only one is shown) extending in the depth direction Z. The supported rails 54 are supported so as to be slidable along support rails 56 provided on the device body 14. With this structure, the upper tray 16 is accommodated in the device body 14 in a manner capable of being pulled out, and the upper tray 16 can be pulled out when the extension part 22 is not attached. The upper tray 16 cannot be pulled out when the extension part 22 is attached.

A loading part 60, which can be moved up and down and on which a sheet P is loaded, is provided inside the upper tray 16. The loading part 60 includes a loading plate made of, for example, a metal plate.

The top surface of the loading plate, which constitutes the loading part 60, serves as a loading surface on which a sheet P is loaded. Thus, the loading part may be rephrased as a loading surface. The loading part 60 can support a normal sheet or the height-increasing member 24.

First guide projections 62 and second guide projections 64 (only those on one end are shown) project from both ends of the loading part 60 in the depth direction Z. The first guide projections 62 (only the projection on the front plate 44 side is shown, and the same is true for the description below) pass through first elongated holes 66 formed in the front plate 44 and the rear plate 46 and are movable along the first elongated holes 66. The second guide projections 64 pass through second elongated holes 68 formed in the front plate 44 and the rear plate 46 and are movable along the second elongated holes 68. This structure allows the loading part 60 to be moved up and down.

As shown in FIG. 3, the sheet feed device 10 includes a lifting mechanism 70 for lifting the loading part 60. The lifting mechanism 70 includes a lifting/lowering part 72 for lifting and lowering the loading part 60, and a driving part 74 for lifting the loading part 60 via the lifting/lowering part 72 and keeps the loading part 60 at the lifted position.

The sheet feed device 10 also includes a disconnecting part 76 that disconnects the lifting/lowering part 72 and the driving part 74 when an uncoupling operation is accepted in a state in which the upper tray 16 is accommodated in the device body 14. The disconnecting part 76 includes a coupling part 78 that releasably couples the driving part 74 and the lifting/lowering part 72, and an uncoupling part 80 that uncouples the driving part 74 and the lifting/lowering part 72 by actuating the coupling part 78.

Driving Part

The driving part 74 includes a driving motor provided in the device body 14. An example of the driving motor is a stepping motor that generates holding power when powered and has a large drag torque.

Figure 4:
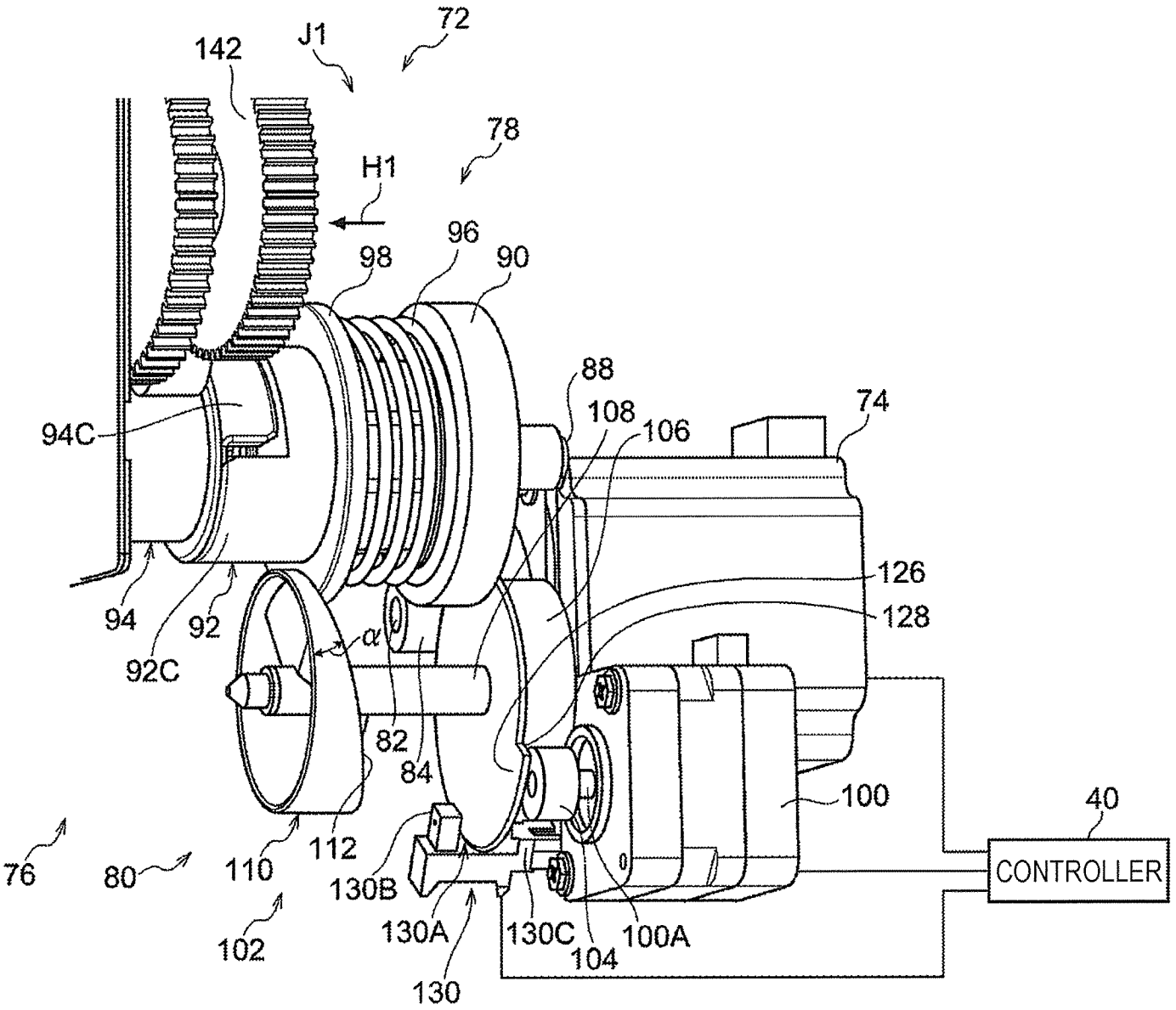
FIG. 4 shows a state in which a coupling according to the first exemplary embodiment is coupled, as viewed from the side.

As shown in FIG. 4, the output of the driving part 74 is transmitted to a geared rotary shaft 88, which constitutes the coupling part 78 of the disconnecting part 76, via a driving gear 84 provided on an output shaft 82 of the driving part 74 and via an intermediate gear 86 (see FIGS. 3 and 5) in mesh with the driving gear 84. The intermediate gear 86 and the geared rotary shaft 88 are supported by the device body 14.

Coupling Part

As shown in FIG. 3, the coupling part 78, which constitutes the disconnecting part 76, includes a circular-plate part 90 that is disposed on the base-end side (i.e., the side closer to the driving part 74) of the geared rotary shaft 88 and that rotates with the geared rotary shaft 88. The coupling part 78 also includes a driving-side coupling 92 that is disposed at a position closer to the distal end than the circular-plate part 90 is and is supported so as to be movable along the geared rotary shaft 88. The coupling part 78 also includes a driven-side coupling 94 that is releasably coupled to the driving-side coupling 92, and a force-applying part 96 that is provided between the circular-plate part 90 and the driving-side coupling 92 (see FIG. 4).

Circular-Plate Part

Figure 5:
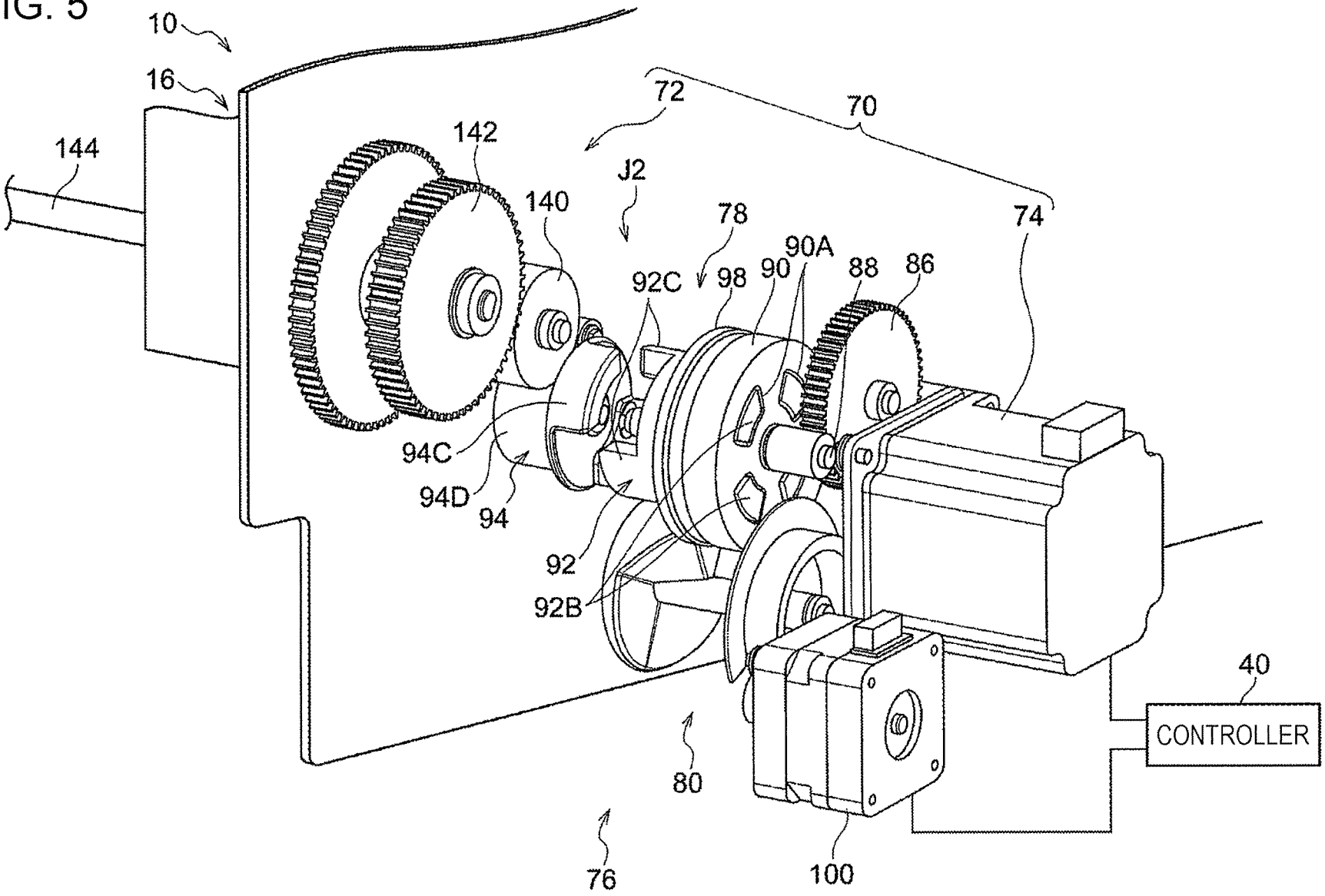
FIG. 5 is a perspective view showing a state in which the coupling according to the first exemplary embodiment is uncoupled.

As shown in FIGS. 3 and 5, the circular-plate part 90 has four rectangular circular-plate-side openings 90A around the geared rotary shaft 88. The circular-plate part 90 also has, between the circular-plate-side openings 90A, circular-plate-side claws 90B projecting toward the driving-side coupling 92.

Driving-Side Coupling

The driving-side coupling 92 is formed in a cylindrical shape and has, at the end thereof adjacent to the circular-plate part 90, a flange 98 extending toward the side.

The driving-side coupling 92 has four coupling-side openings 92A, into which the circular-plate-side claws 90B on the circular-plate part 90 are removably inserted, around the geared rotary shaft 88. The driving-side coupling 92 also has, between the coupling-side openings 92A, coupling-side claws 92B projecting toward the circular-plate part 90. The coupling-side claws 92B can be inserted into and removed from the circular-plate-side openings 90A in the circular-plate part 90.

The coupling-side claws 92B on the driving-side coupling 92 are disposed between the circular-plate-side claws 90B on the circular-plate part 90, and the rotational force of the circular-plate part 90 rotated by the driving part 74 is transmitted to the driving-side coupling 92 via the claws 90B and 92B. Thus, the driving-side coupling 92 can be rotated by the driving part 74.

Furthermore, by inserting the circular-plate-side claws 90B on the circular-plate part 90 into the coupling-side openings 92A and inserting the coupling-side claws 92B into the circular-plate-side openings 90A in the circular-plate part 90, the driving-side coupling 92 can be moved toward the circular-plate part 90, along the geared rotary shaft 88.

Figure 6:
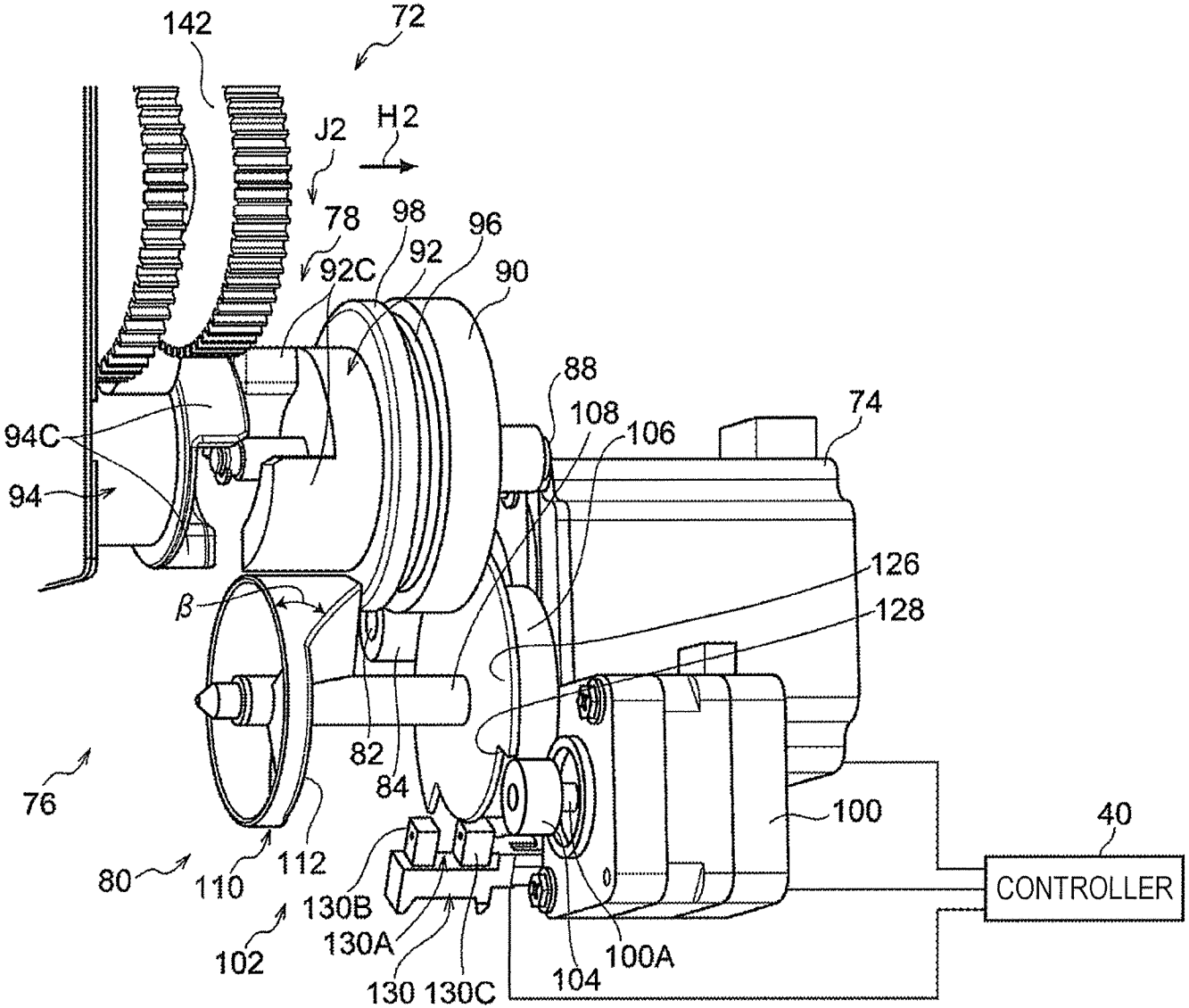
FIG. 6 is a side view showing a state in which the coupling according to the first exemplary embodiment is uncoupled.

With this configuration, the driving-side coupling 92 is brought into either a coupled state J1, in which the driving-side coupling 92 is disposed on the distal-end side and is coupled to the driven-side coupling 94, as shown in FIGS. 3 and 4, or an uncoupled state J2, in which the driving-side coupling 92 is moved to the base-end side and is uncoupled from the driven-side coupling 94, as shown in FIGS. 5 and 6.

As shown in FIG. 6, the driving-side coupling 92 has, on the distal-end face thereof, two arc-shaped driving teeth 92C projecting toward the driven-side coupling 94 and spaced apart from each other.

Driven-Side Coupling

The driven-side coupling 94 is rotatably supported by the upper tray 16 and moves in a pull-out direction along with the upper tray 16.

The driven-side coupling 94 is formed in a cylindrical shape and has, on the end face thereof adjacent to the driving-side coupling 92, two arc-shaped driven teeth 94C projecting toward the driving-side coupling 92 and spaced apart from each other. The driving teeth 92C on the driving-side coupling 92 can be inserted into and removed from the spaces between the driven teeth 94C, and the driving teeth 94C on the driven-side coupling 94 can be inserted into and removed from the spaces between the driving teeth 92C.

With this configuration, as shown in FIGS. 3 and 4, the driven-side coupling 94 and the driving-side coupling 92 can be rotated together in the coupled state J1, in which the driving teeth 92C are disposed between the driven teeth 94C. Furthermore, the driven-side coupling 94 transmits the rotational force of the driving-side coupling 92 to the lifting/lowering part 72.

Furthermore, as shown in FIGS. 5 and 6, in the uncoupled state J2, in which the driving teeth 92C are removed from the spaces between the driven teeth 94C, the driven-side coupling 94 and the driving-side coupling 92 can be rotated independently.

Force-Applying Part

The force-applying part 96 provided between the circular-plate part 90 and the driving-side coupling 92 is an elastic member, such as a coil spring. As shown in FIG. 4, the force-applying part 96 applies a force to the driving-side coupling 92 in a coupling direction H1, in which the driving-side coupling 92 is coupled to the driven-side coupling 94.

Uncoupling Part

As shown in FIGS. 4 and 6, the uncoupling part 80, which constitutes the disconnecting part 76, includes a cam driving part 100 provided in the device body 14 and a cam part 102 rotationally driven by the cam driving part 100. The uncoupling part 80 uncouples the driving-side coupling 92 and the driven-side coupling 94 by moving the driving-side coupling 92 in an uncoupling direction H2 in a state in which the upper tray 16 is accommodated in the device body 14.

Cam Driving Part

The cam driving part 100 is a driving motor controlled by the controller 40. An example of the driving motor constituting the cam driving part 100 is a stepping motor. The cam driving part 100 controls rotation, stopping, and the rotation speed.

An output gear 104, which is connected to the cam part 102, is provided on the output shaft 100A of the cam driving part 100.

Cam Part

The cam part 102 includes a driven gear 106 in mesh with the output gear 104 of the cam driving part 100, a rotary shaft 108 that rotates with the driven gear 106, and a cam 110 fixed at the distal end of the rotary shaft 108.

The end face of the cam 110 closer to the driven gear 106 constitutes a cam face 112, which is in contact with the flange 98 of the driving-side coupling 92 from the driven-side coupling 94 side and moves the driving-side coupling 92 in the uncoupling direction H2.

Although the cam face 112 is in contact with the driving-side coupling 92 to move the driving-side coupling 92 in the uncoupling direction H2 in this exemplary embodiment, the configuration is not limited thereto. For example, the cam face 112 may be in contact with the driven-side coupling 94 and move the driven-side coupling 94 in the uncoupling direction to uncouple the driving-side coupling 92 and the driven-side coupling 94.

Figure 7:
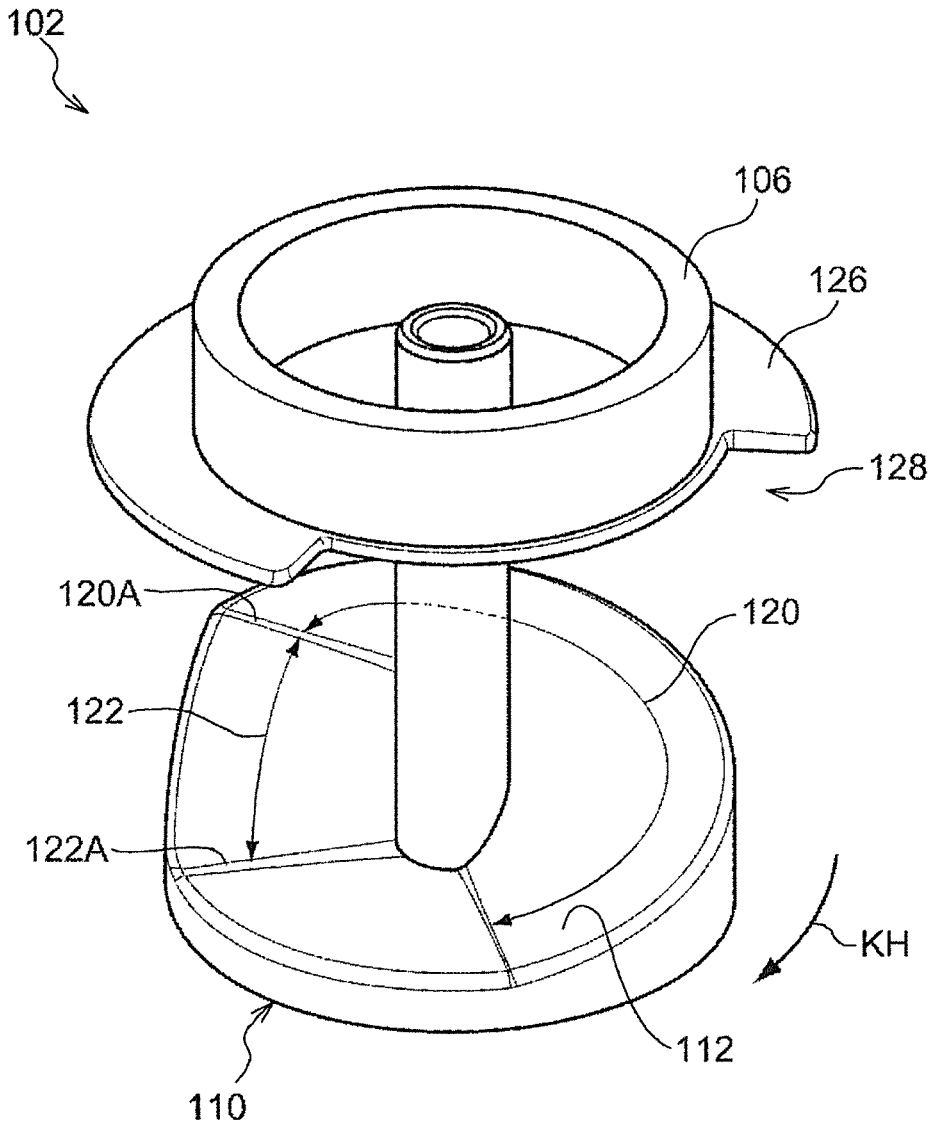
FIG. 7 is an enlarged view of an uncoupling part of the coupling according to the first exemplary embodiment.

As shown in FIG. 7, the cam face 112 has a first slope area 120 along which the driving-side coupling 92 is moved in the uncoupling direction H2 and a second slope area 122 along which the driving-side coupling 92 can be moved in the coupling direction H1. The first and second slope areas 120 and 122 are disposed in this order in the circumferential direction. The first slope area 120 and the second slope area 122 are disposed such that the first slope area 120 and the second slope area 122 sequentially come into contact with the flange 98 of the driving-side coupling 92 when the cam driving part 100 rotates the cam 110.

In other words, the height of the first slope area 120 gradually increases in the direction opposite to the rotation direction KH, in which the cam driving part 100 rotates the cam 110. The driving-side coupling 92 and the driven-side coupling 94 are uncoupled at a terminal end 120A, which is the highest portion of the first slope area 120. The height of the second slope area 122 gradually decreases in the direction opposite to the rotation direction KH, in which the cam driving part 100 rotates the cam 110. The driving-side coupling 92 and the driven-side coupling 94 can be coupled to each other at a terminal end 122A, which is the lowest portion in the second slope area 122.

The first inclination angle α formed between the distal-end edge (i.e., the plane perpendicular to the shaft) of the cam 110 and the surface constituting the first slope area 120, as shown in FIG. 4, is more gentle than a second inclination angle β formed between the distal-end edge of the cam 110 and the surface constituting the second slope area 122, as shown in FIG. 6.

With this configuration, the driving-side coupling 92 moves slowly in the uncoupling direction H2, in which the driving-side coupling 92 moves away from the driven-side coupling 94, and moves quickly in the coupling direction H1, in which the driving-side coupling 92 is coupled to the driven-side coupling 94.

A block plate 126 is provided on an end face of the driven gear 106 of the cam part 102. The block plate 126 has a cut-away portion 128.

The device body 14 includes an angle sensor 130 for detecting the rotation angle of the cam part 102. The angle sensor 130 is connected to the controller 40. The angle sensor 130 is, for example, a light sensor and has a space 130A in which the block plate 126 is disposed.

The angle sensor 130 has a light emitting part 130B that outputs light toward one side of the block plate 126 disposed in the space 130A, and a light receiving part 130C provided on the other side of the block plate 126 to receive the light. The angle sensor 130 detects the position of the cut-away portion 128 in the block plate 126 based on whether the light emitted from the light emitting part 130B to the light receiving part 130C is blocked by the block plate 126, thereby obtaining the rotation angle of the rotated cam part 102.

As shown in FIG. 6, while the driving-side coupling 92 and the driven-side coupling 94 are uncoupled, the cut-away portion 128 in the block plate 126 moves in the space 130A in the angle sensor 130. As a result, the controller 40 grasps whether the driving-side coupling 92 and the driven-side coupling 94 are in the coupled state J1 or in the uncoupled state J2, based on the output from the angle sensor 130. Furthermore, the controller 40 can couple or uncouple the driving-side coupling 92 and the driven-side coupling 94 by rotationally controlling the cam driving part 100 based on the output from the angle sensor 130.

Lifting/Lowering Part

As shown in FIG. 3, the lifting/lowering part 72 is provided on the upper tray 16 and includes the above-described driven-side coupling 94, which is rotatably supported by the rear plate 46 of the upper tray 16.

A gear part 94D formed on the base-end side of the driven-side coupling 94 is engaged with a rotary gear 142 via a transmission gear 140. One end of a pulley shaft 144 is fixed to the rotary gear 142, and, as shown in FIG. 2, a winding pulley 146 rotatably supported by the front plate 44 is fixed to the other end of the pulley shaft 144.

A first wire 148 and a second wire 150 are wound on the winding pulley 146 in a manner capable of being paid out. The first wire 148 led out of the winding pulley 146 is guided downward by a first pulley 152 provided above the first elongated hole 66. The distal end of the first wire 148 is fixed to the first guide projection 62 projecting through the first elongated hole 66.

The second wire 150 led out of the winding pulley 146 is guided downward by a second pulley 154 provided above the second elongated hole 68. The distal end of the second wire 150 is fixed to the second guide projection 64 projecting through the second elongated hole 68.

This structure for supporting the loading part 60 with the wires 148 and 150 is provided also on the rear plate 46 side.

With this configuration, the loading part 60, from which the first guide projection 62 and the second guide projections 64 extend, can be hoisted by the wires 148 and 150. When the driving part 74 is rotationally driven in a state in which the upper tray 16 is accommodated in the device body 14 and in which the coupling part 78 is coupled, the loading part 60 is lifted by the lifting/lowering part 72. Even if the power to the driving part 74 is turned off in this state, the loading part 60 is maintained at the lifted position by the drag torque of the driving part 74.

Meanwhile, when the upper tray 16 is pulled out of the device body 14, the driven-side coupling 94 is separated from the driving-side coupling 92, and the coupled state J1 is released. As a result, the loading part 60 moves down due to its own weight.

Also in a state in which the upper tray 16 is accommodated in the device body 14, the controller 40 can accept an uncoupling operation and can release the coupled state J1 between the driven-side coupling 94 and the driving-side coupling 92 by rotationally driving the cam driving part 100. Thus, it is possible to separate the lifting/lowering part 72 and the driving part 74, allowing the loading part 60 to move down due to its own weight.

Effects and Advantages

Effects and advantages of this exemplary embodiment will be described.

In the related-art structure, the upper tray 16 cannot be pulled out of the device body 14 in a state in which the extension part 22 is attached to the device body 14. Hence, the loading part 60 cannot be lowered in response to pulling out of the upper tray 16. Hence, if the uncoupling part 80 according to this exemplary embodiment is not provided, the driving part 74 needs to be reversely rotated to lower the loading part 60.

In contrast, in this exemplary embodiment, compared with the configuration in which the loading part 60 cannot be lowered in a state in which the upper tray 16 is accommodated in the device body 14, the loading part 60 can be lowered in response to pulling out of the tray, without needing to reversely rotate the motor for lifting the loading part 60.

This eliminates the need to reversely rotate the motor, simplifies the motor control, and also eliminates the need to provide a sensor for detecting arrival of the loading part 60 at the lower limit.

Furthermore, compared with the configuration in which the loading part 60 is lowered by its own weight when the upper tray is pulled out and is forcibly lowered by a reversely rotated motor when the upper tray is accommodated, the time taken to lower the loading part 60 when the upper tray is pulled out and the time taken to lower the loading part 60 when the upper tray is accommodated are equal.

This reduces a feeling of strangeness caused by the difference in time taken to lower the loading part 60.

Furthermore, the disconnecting part 76 for disconnecting the lifting/lowering part 72 and the driving part 74 includes the driving-side coupling 92, the driven-side coupling 94, and the uncoupling part 80 for uncoupling the driving-side coupling 92 and the driven-side coupling 94.

Hence, compared with the configuration in which the disconnecting part 76 is formed of a clutch, the driving-force transmission loss can be reduced.

Furthermore, the cam face 112 of the cam 110, which is in contact with the driving-side coupling 92 and moves the driving-side coupling 92 in the uncoupling direction H2, has the first slope area 120 along which the driving-side coupling 92 is moved in the uncoupling direction H2 and the second slope area 122 along which the driving-side coupling 92 can be moved in the coupling direction H1. The first and second slope areas 120 and 122 are disposed in this order in the circumferential direction of the cam 110.

Hence, compared with the configuration in which the coupling is uncoupled by driving a rack with a motor, the coupling can be uncoupled by rotating the cam 110 in one direction.

Furthermore, the first inclination angle $\alpha$ of the first slope area 120 is more gentle than the second inclination angle $\beta$ of the second slope area 122.

Hence, compared with a case where the first inclination angle $\alpha$ of the first slope area 120 is steeper than the second inclination angle $\beta$ of the second slope area 122, the load (applied to the cam driving part 100) when uncoupling the coupling can be reduced, while enabling quick coupling of the coupling.

The acceptance of the uncoupling operation is performed based on the opening operation of the cover 30.

Hence, compared with the configuration in which the acceptance of the uncoupling operation is performed based on an operation of a switch, the usability is high.

Although the driving-side coupling 92 and the driven-side coupling 94 are uncoupled by the cam 110 in this exemplary embodiment, the driving-side coupling 92 and the driven-side coupling 94 may be uncoupled by using, for example, a linear actuator, such as a solenoid actuator.

Second Exemplary Embodiment

FIGS. 8 to 11 show a second exemplary embodiment. In the description below, components that are the same as or similar to those in the first exemplary embodiment are denoted by the same reference signs, and different portions will be described. A sheet feed device 200 according to this exemplary embodiment differs from the sheet feed device according to the first exemplary embodiment in the configuration of the disconnecting part 76.

The disconnecting part 76 according to this exemplary embodiment includes a clutch 202 (see FIG. 9) that establishes a connected state S1, in which the driving part 74 is connected to the lifting/lowering part 72. The clutch 202 includes an uncoupling part 204 that is actuated when the connected state S1 is released. The disconnecting part 76 further includes an actuator 206 (see FIGS. 11 and 12) that actuates the uncoupling part 204 when an uncoupling operation is accepted.

Clutch

Figure 8:
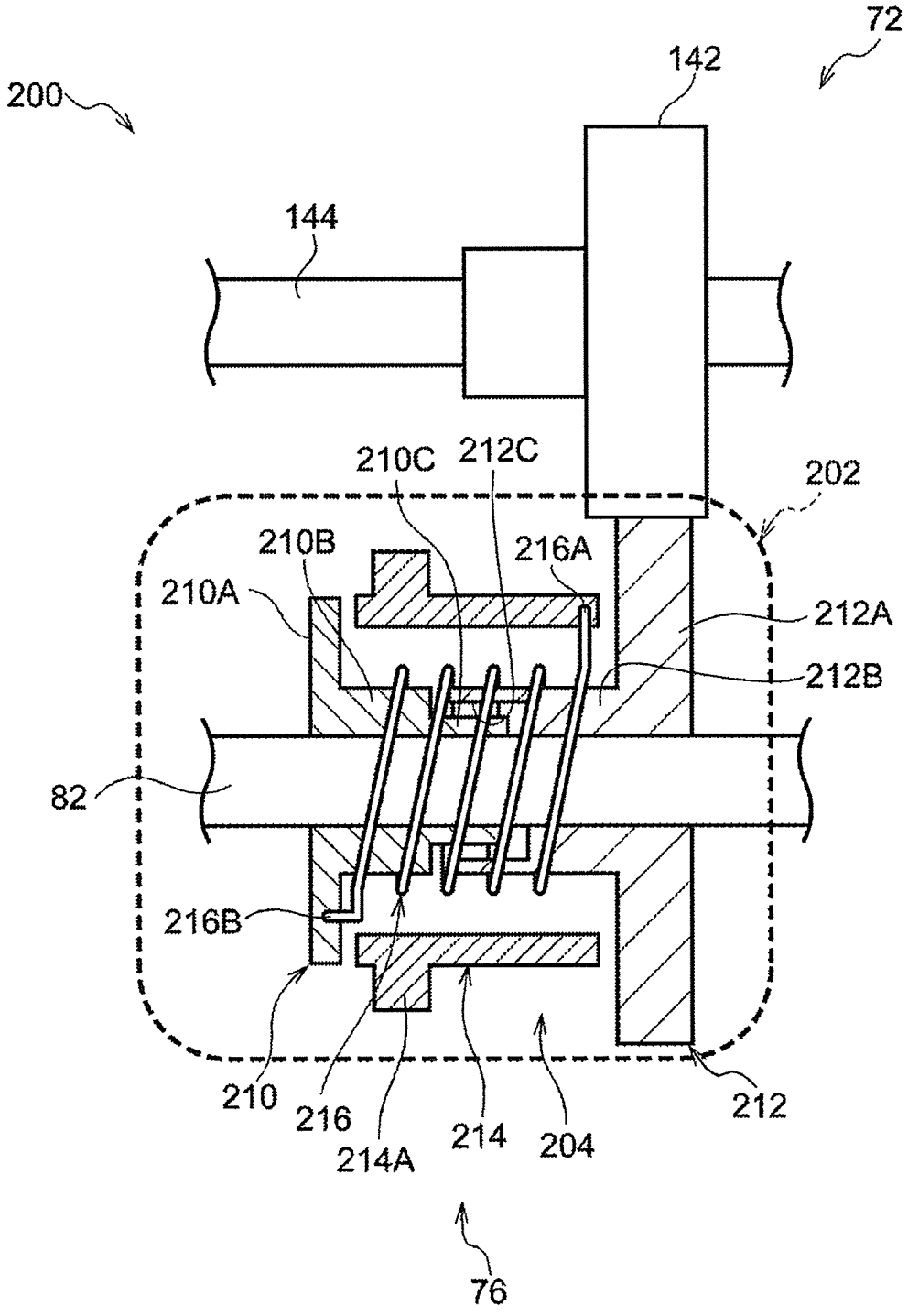
FIG. 8 is a partial sectional view of a clutch according to a second exemplary embodiment.

More specifically, as shown in FIG. 8, the clutch 202 includes a fixed part 210 fixed to the outer circumference of the output shaft 82 of the driving part 74, and an output part 212 that is rotatably supported on the outer circumference of the output shaft 82, on the distal-end side of the fixed part 210. The clutch 202 also includes a cylindrical part 214 disposed between the fixed part 210 and the output part 212, and a torsion spring 216 disposed inside the cylindrical part 214.

The fixed part 210 includes a circular-plate-shaped base 210A, a large-diameter cylindrical part 210B projecting from the base 210A, and a small-diameter cylindrical part 210C projecting from the large-diameter cylindrical part 210B.

The output part 212 includes a gear part 212A in mesh with the rotary gear 142 of the pulley shaft 144, which constitutes the lifting/lowering part 72, and a cylindrical part 212B projecting toward the fixed part 210 from the gear part 212A. The cylindrical part 212B has a fitting recess 212C into which the small-diameter cylindrical part 210C of the fixed part 210 is fitted.

Figure 11:
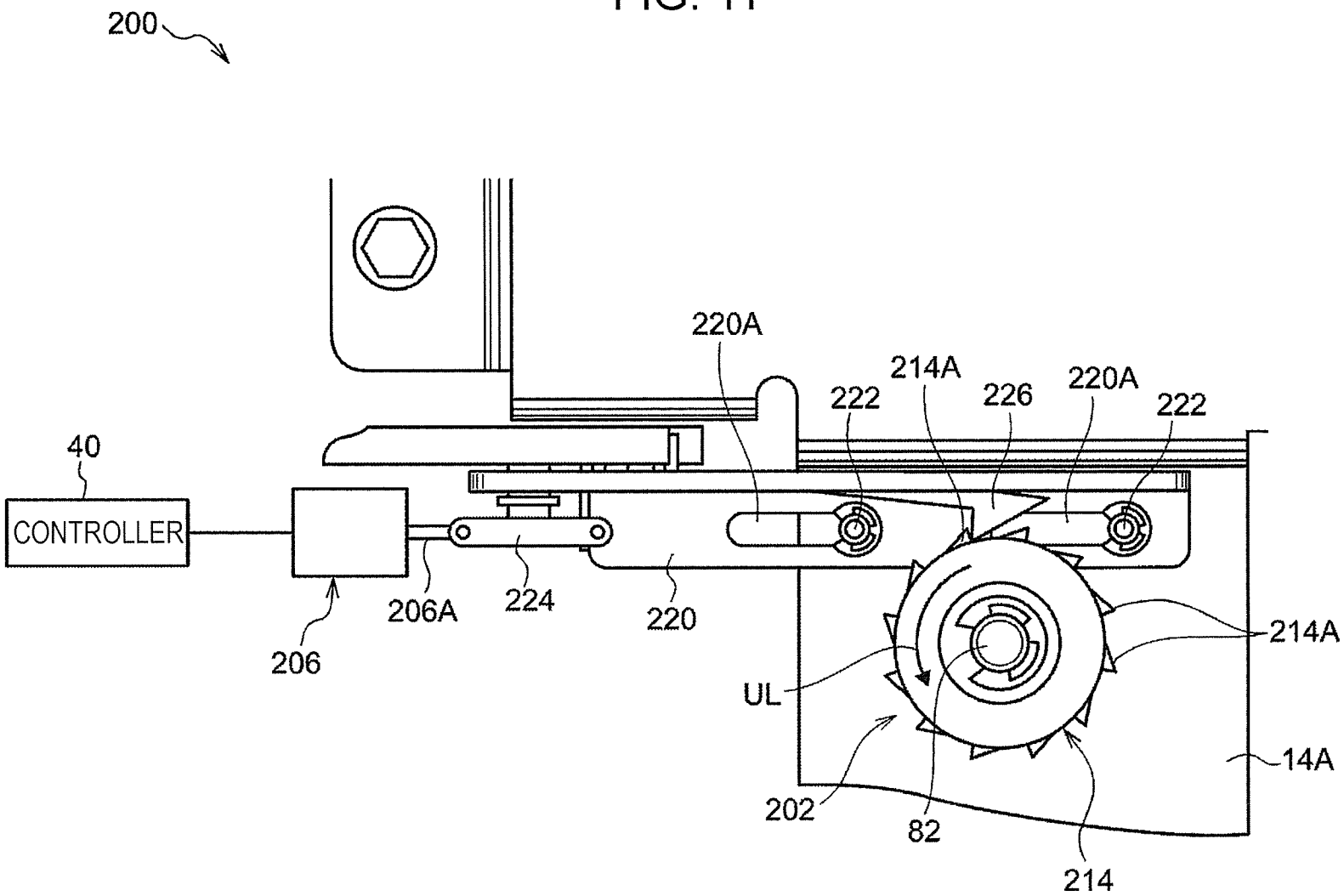
FIG. 11 is a side view of an actuator for controlling the engagement state of the clutch according to the second exemplary embodiment.
Figure 12:
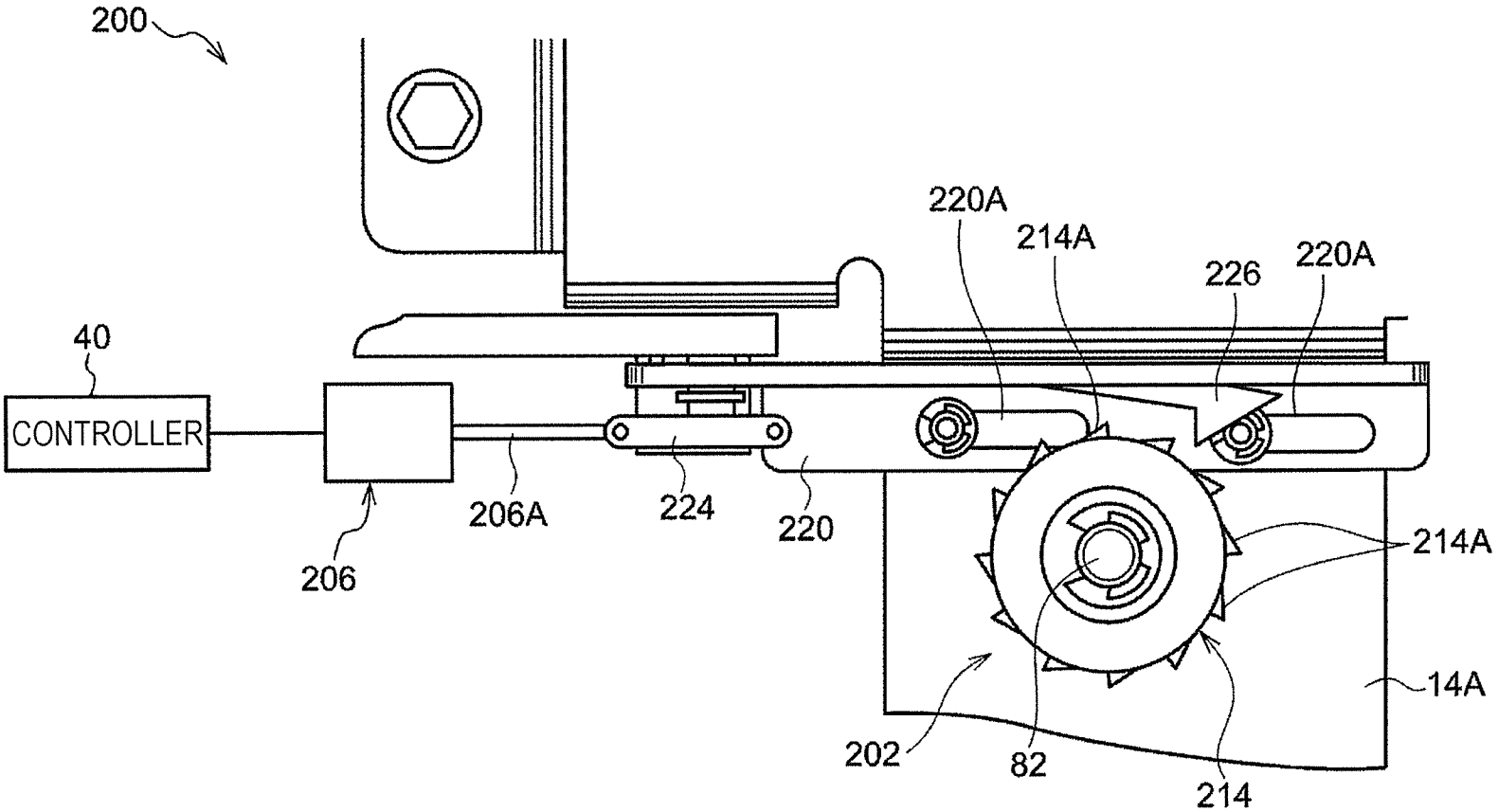
FIG. 12 is a side view showing a state in which the actuator according to the second exemplary embodiment is not operating.

The cylindrical part 214 is disposed so as to surround the large-diameter cylindrical part 210B of the fixed part 210 and the cylindrical part 212B of the output part 212 and has multiple projections 214A projecting to the side (see FIGS. 11 and 12).

The torsion spring 216 is disposed on the outer circumferences of the large-diameter cylindrical part 210B of the fixed part 210 and the cylindrical part 212B of the output part 212. One end 216A of the torsion spring 216 is fixed to an end of the cylindrical part 214, and the other end 216B of the torsion spring 216 is fixed to the base 210A of the fixed part 210.

As shown in FIGS. 11 and 12, a slide plate 220 is supported on the housing 14A of the device body 14 so as to be slidable in the length direction. The slide plate 220 is supported on the housing 14A with fixing members 222 passing through elongated holes 220A extending in the length direction. An actuation shaft 206A of the actuator 206 is connected to the slide plate 220 via a link member 224, whereby the slide plate 220 is moved in the length direction by the actuator 206. The actuator 206 is, for example, a solenoid actuator.

Alternatively, the actuator 206 may be a combination of a motor and a cam or a combination of a motor, a gear, and a rack. Furthermore, the operation force of the cover 30 that is opened may be transmitted to the slide plate 220 via a link.

An operation claw 226, which can come into contact with the projections 214A on the cylindrical part 214 of the clutch 202, is fixed to the slide plate 220. With this configuration, as shown in FIG. 11, by moving the slide plate 220 with the actuator 206, the projections 214A on the cylindrical part 214 can be rotated in an uncoupling direction UL with the operation claw 226.

Connected State

Figure 9:
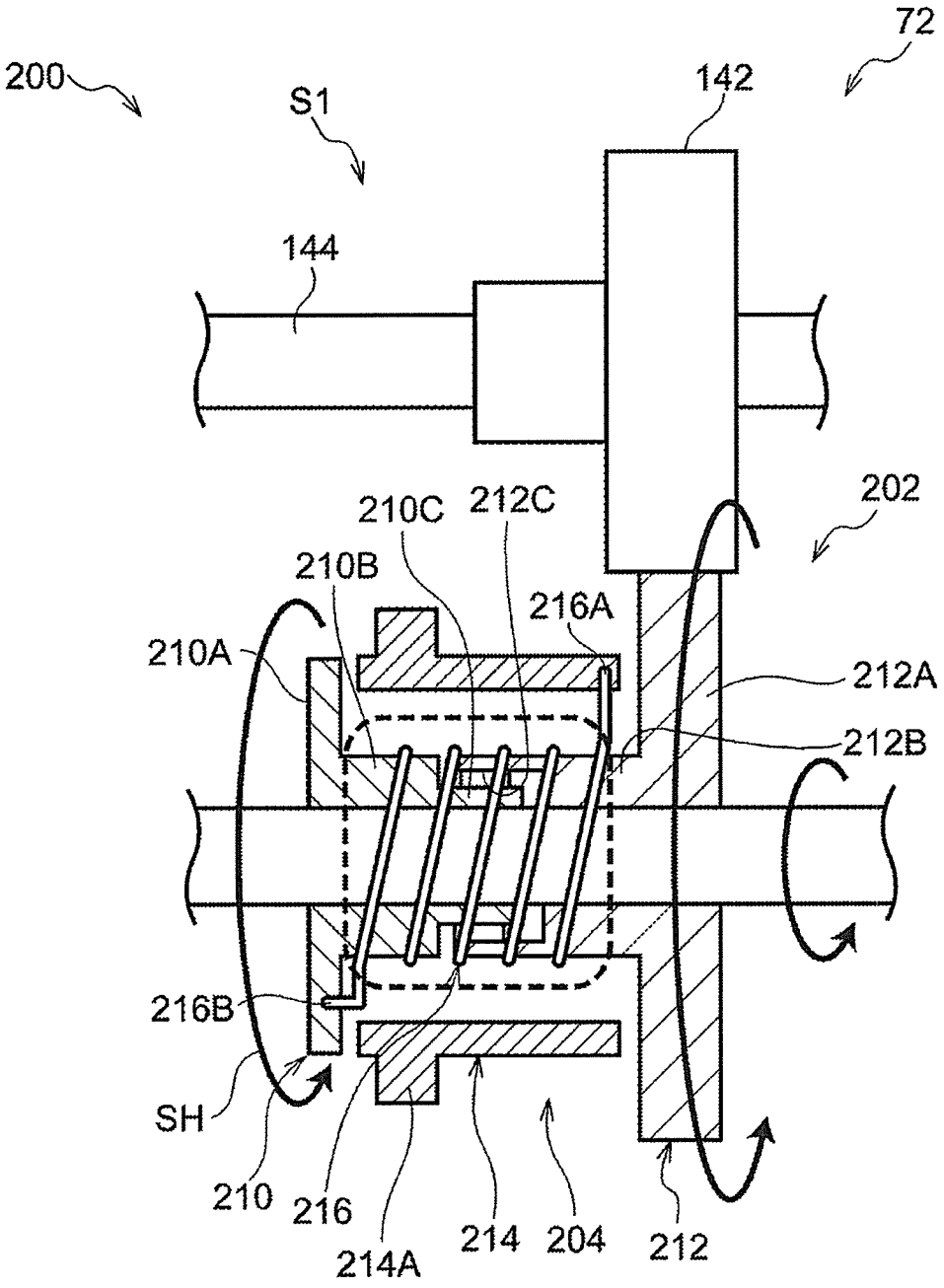
FIG. 9 is a partial sectional view showing a state in which the clutch according to the second exemplary embodiment is engaged.

As shown in FIG. 12, when the output shaft 82 of the driving part 74 rotates in the direction SH, in which the torsion spring 216 is tightened, while the actuator is not actuated, as shown in FIG. 9, the cylindrical part 212B of the output part 212 is fastened by the torsion spring 216. This increases the friction between the cylindrical part 212B of the output part 212 and the small-diameter cylindrical part 210C of the fixed part 210 fitted into the fitting recess 212C, establishing the connected state S1, in which the driving part 74 is connected to the lifting/lowering part 72. In this state, the output of the driving part 74 is transmitted to the lifting/lowering part 72.

Uncoupled State

When the cover 30 is opened, and consequently, the cover open state is detected, the controller 40 recognizes that an uncoupling operation is accepted. Then, as shown in FIG. 11, the controller 40 actuates the actuator 206 to rotate the cylindrical part 214 in the uncoupling direction UL with the operation claw 226. The operating time of the actuator 206 at this time is the maximum time needed to lower the loading part 60 plus a predetermined time (+a).

Figure 10:
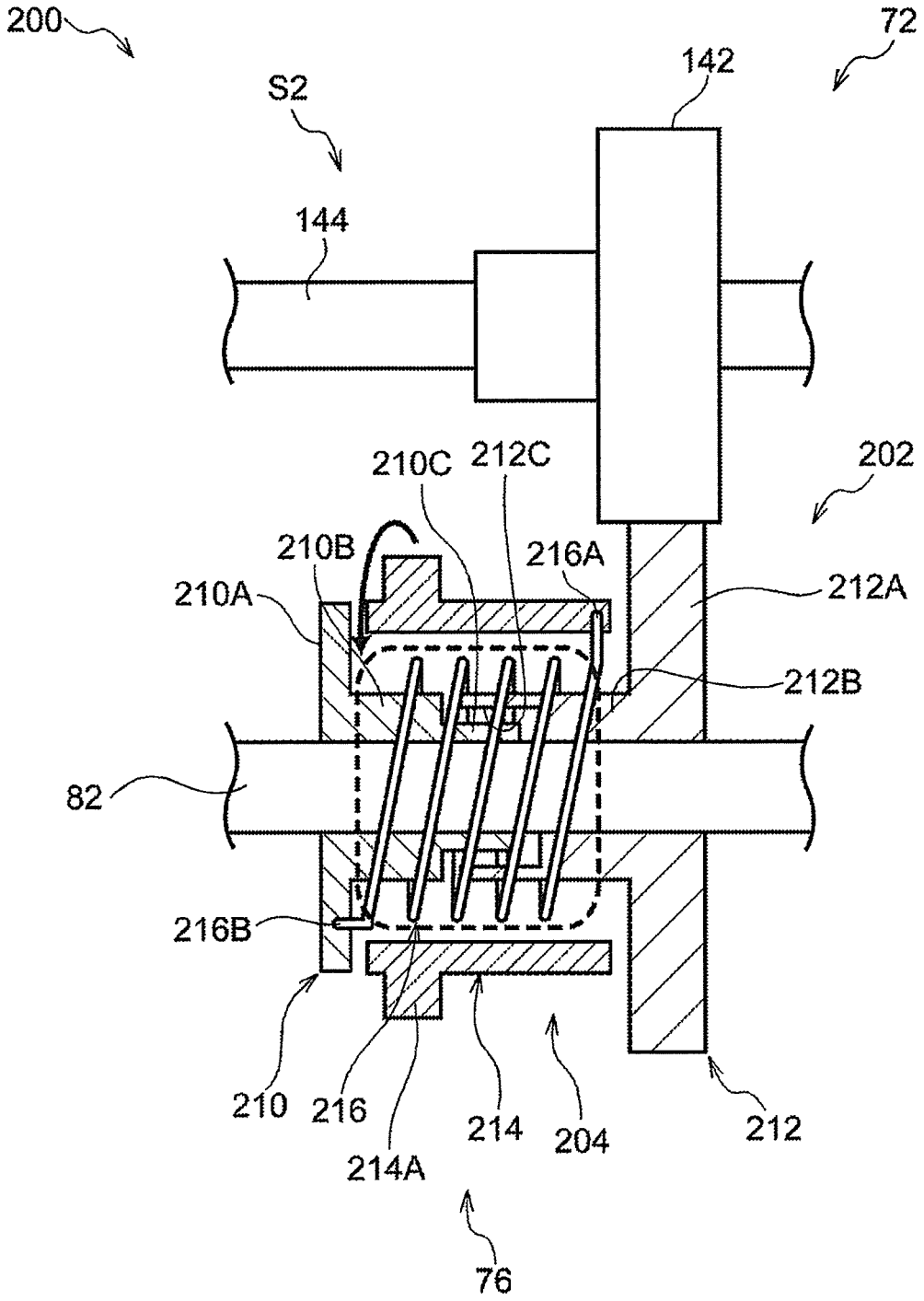
FIG. 10 is a partial sectional view showing a state in which the clutch according to the second exemplary embodiment is disengaged.

As shown in FIG. 10, as a result of the torsion spring 216 being increased in diameter and loosened, the cylindrical part 212B of the output part 212 is released, allowing the output part 212 to freely rotate relative to the output shaft 82 of the driving part 74. Thus, an uncoupled state S2, in which the driving part 74 and the lifting/lowering part 72 are uncoupled, is established.

Effects and Advantages

Also in this exemplary embodiment, the components the same as or similar to those according to the first exemplary embodiment provide the same effects and advantages as those obtained in the first exemplary embodiment.

Furthermore, the disconnecting part 76 according to this exemplary embodiment has the clutch 202, and the clutch 202 has the uncoupling part 204 actuated when releasing the connected state S1.

Hence, compared with the configuration in which the disconnecting part 76 is formed of a coupling, impact caused in connecting can be reduced.

The disconnecting part 76 further has the actuator 206 for actuating the uncoupling part 204 when an uncoupling operation is accepted.

Hence, compared with the configuration in which the operation force of an uncoupling lever operated by hand is transmitted to the uncoupling part 204 to actuate the uncoupling part 204, the structure is simple.

Although the combination of the sheet feed device 10 and the image forming apparatus 12 has been described in the above-described exemplary embodiments, the combination is not limited to the above-described combination, and the sheet feed device 10 according to the exemplary embodiments may be combined with a device other than the image forming apparatus 12. Furthermore, although the sheet P has been described as a sheet of paper or an OHP sheet made of PET resin, the sheet P may be any sheet-like medium, such as a fabric sheet, a metal sheet, or a sheet-like food.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet feed device comprising:

a tray provided in a device body in a manner capable of being pulled out and having a loading part that is moved up and down;

an extension part attached to the device body to support a portion of a sheet to be fed through the tray;

a lifting mechanism that has a lifting/lowering part for moving the loading part up and down and a driving part for lifting and holding the loading part via the lifting/lowering part; and a disconnecting part that disconnects the lifting/lowering part and the driving part when an uncoupling operation is accepted in a state in which the tray is accommodated in the device body.

2. The sheet feed device according to claim 1, wherein the disconnecting part includes:

a driving-side coupling rotated by the driving part;

a driven-side coupling for transmitting the rotational force of the driving-side coupling to the lifting/lowering part;

a force-applying part for applying a force in a direction in which the driving-side coupling and the driven-side coupling are coupled to each other; and an uncoupling part that moves the driving-side coupling or the driven-side coupling in an uncoupling direction to uncouple the driving-side coupling and the driven-side coupling.

3. The sheet feed device according to claim 2, wherein the uncoupling part has a cam having a cam face that is in contact with the driving-side coupling or the driven-side coupling to move the driving-side coupling or the driven-side coupling in the uncoupling direction, and the cam face has a first slope area along which the driving-side coupling or the driven-side coupling is moved in the uncoupling direction and a second slope area along which the driving-side coupling or the driven-side coupling can be moved in the coupling direction, the first and second slope areas being disposed in this order in a circumferential direction.

4. The sheet feed device according to claim 3, wherein an inclination angle of the first slope area is more gentle than an inclination angle of the second slope area.

5. The sheet feed device according to claim 4, further comprising a cover for a sheet accommodating part including the extension part, wherein the acceptance of the uncoupling operation is performed based on an opening operation of the cover.

6. The sheet feed device according to claim 3, further comprising a cover for a sheet accommodating part including the extension part, wherein the acceptance of the uncoupling operation is performed based on an opening operation of the cover.

7. The sheet feed device according to claim 2, further comprising a cover for a sheet accommodating part including the extension part, wherein the acceptance of the uncoupling operation is performed based on an opening operation of the cover.

8. The sheet feed device according to claim 1, wherein the disconnecting part has a clutch that establishes a connected state in which the driving part is connected to the lifting/lowering part, and the clutch has an uncoupling part actuated when the connected state is released.

9. The sheet feed device according to claim 8, wherein the disconnecting part further has an actuator for actuating the uncoupling part when the uncoupling operation is accepted.

10. The sheet feed device according to claim 9, further comprising a cover for a sheet accommodating part including the extension part, wherein the acceptance of the uncoupling operation is performed based on an opening operation of the cover.

11. The sheet feed device according to claim 8, further comprising a cover for a sheet accommodating part including the extension part, wherein the acceptance of the uncoupling operation is performed based on an opening operation of the cover.

12. The sheet feed device according to claim 1, further comprising a cover for a sheet accommodating part including the extension part, wherein the acceptance of the uncoupling operation is performed based on an opening operation of the cover.

13. A sheet feed device comprising:

a tray provided in a device body in a manner capable of being pulled out and having a loading part that is moved up and down;

extension means, attached to the device body, for supporting a portion of a sheet to be fed through the tray;

lifting means having a lifting/lowering part for moving the loading part up and down and a driving part for lifting and holding the loading part via the lifting/lowering part; and disconnecting means for disconnecting the lifting/lowering part and the driving part when an uncoupling operation is accepted in a state in which the tray is accommodated in the device body.

* * * * *